US009187304B2

(12) United States Patent
Kampmann et al.

(10) Patent No.: US 9,187,304 B2
(45) Date of Patent: Nov. 17, 2015

(54) APPARATUS FOR THE CLOSURE OF CONTAINERS WITH CLEAN ROOM

(75) Inventors: Lutz Kampmann, Moetzing (DE); Klaus Buchhauser, Deuerling (DE); Patrick Engelhard, Elsendorf (DE)

(73) Assignee: KRONES AG (DE)

( * ) Notice: Subject to any disclaimer, the term of this patent is extended or adjusted under 35 U.S.C. 154(b) by 706 days.

(21) Appl. No.: 13/247,290

(22) Filed: Sep. 28, 2011

(65) Prior Publication Data

US 2012/0079792 A1 Apr. 5, 2012

(30) Foreign Application Priority Data

Sep. 28, 2010 (DE) ..... 20 2010 013 681 U

(51) Int. Cl.

*B65B 7/00* (2006.01)
*B67B 3/20* (2006.01)
*B67C 3/22* (2006.01)

(52) U.S. Cl.

CPC ..... *B67B 3/2013* (2013.01); *B67B 2201/08* (2013.01); *B67C 2003/228* (2013.01)

(58) Field of Classification Search

CPC ..... B67B 3/10; B67B 3/20; B67B 3/22; B67B 3/28; B67B 2201/08; B67B 3/2033; B67B 3/2086; B65B 7/00; B67C 2003/228; B67C 7/0086; B67C 7/0073; B67C 3/2642

USPC ..... 53/331.5, 359, 334, 484–485, 490, 426, 53/432; 422/302

See application file for complete search history.

(56) References Cited

U.S. PATENT DOCUMENTS

| | | | | |
|---|---|---|---|---|
| 5,111,635 | A * | 5/1992 | Neber | 53/334 |
| 5,653,091 | A * | 8/1997 | Stark | 53/426 |
| 7,124,552 | B2 * | 10/2006 | Lang | 53/76 |
| 7,353,848 | B2 * | 4/2008 | Krulitsch | 141/56 |
| 8,596,030 | B2 * | 12/2013 | Buchhauser et al. | 53/485 |
| 2001/0010805 | A1 | 8/2001 | Kurth | |
| 2008/0078144 | A1 * | 4/2008 | Cirio | 53/359 |
| 2011/0072760 | A1 | 3/2011 | Drenguis | |
| 2011/0072762 | A1 | 3/2011 | Jakob | |
| 2011/0247301 | A1 | 10/2011 | Buchhauser et al. | |

FOREIGN PATENT DOCUMENTS

| | | | | |
|---|---|---|---|---|
| EP | 1 905 728 B1 | | 4/2008 | |
| WO | WO 2010/052124 | * | 5/2010 | B67B 3/20 |

* cited by examiner

*Primary Examiner* — Gloria R Weeks
*Assistant Examiner* — Justin Citrin
(74) *Attorney, Agent, or Firm* — Hayes Soloway P.C.

(57) ABSTRACT

An apparatus for the closure of containers may include at least one closure head for applying the closures. The at least one closure head is situated in a clean room sealed off by a medium. The apparatus including a movement device arranged at least in part in the clean room. The movement device is configured to produce a rotational movement of the closure head about a longitudinal axis of the movement device and a translational movement of the closure head along the longitudinal axis of the movement device. The movement device is contacted at least locally by the medium for sealing off the clean room from a non-clean room.

18 Claims, 2 Drawing Sheets

APPARATUS FOR THE CLOSURE OF CONTAINERS WITH CLEAN ROOM

CROSS-REFERENCE TO RELATED APPLICATION

This application claims the benefit of priority of German Patent Application No. 20 2010 013 681.4, filed Sep. 28, 2010, pursuant to 35 U.S.C. 119(a)-(d), the disclosure of which is incorporated herein by reference.

TECHNICAL FIELD

The present disclosure relates to an apparatus for the closure of containers and, more particularly, for the closure of containers by screw-type closures.

BACKGROUND

A container treatment plant known generally from the prior art has for example a portion for heating the containers, a portion for inflating and stretching the containers, a portion for sterilizing the containers and a portion for closing the containers.

In this case the portion or the plant for closing the containers comprises for example at least one apparatus for closing the containers which has at least one closure head for applying the closure caps to the containers, a movement device for transferring a rotational and a translational movement of a motor to the closure head and a clean room in which the containers are moved during the procedure.

A closure head for an automatic lid application machine is described for example in EP 1 905 728 B1, which has a support, a turning shaft and a lid-gripping element. The support has mounted on it a rotatable turning shaft which is surrounded by a sleeve which forms a chamber which is sealed off around the turning shaft and which is filled with a disinfection agent, the sleeve being stationary with respect to the support. The chamber is closed by two mechanical seals which in each case have a stationary part and a turning part. The sleeve itself extends through an opening in an upper stationary plate and has on its external periphery a bellows, the upper end of which is mounted on the stationary plate and the lower end of which is mounted on the sleeve. In addition, the chamber is connected to an inlet opening and an outlet opening for the disinfection agent, the openings being situated above the stationary plate and thus in the non-sterile area. In this case sealing the non-sterile area off from a sterile area by means of an hydraulic seal is carried out only by way of the sleeve, which must additionally have a seal in the region of the plate which it passes through. Accordingly, sealing systems provided in addition to a hydraulic seal are required.

DE 10 2008 034 389 A1 describes inter alia a closure machine for the closure of bottles, which has a functional element which has a wall separating a sterile room from a non-sterile room and with an hydraulic seal which permits a relative movement of the functional element with respect to the wall. The closure machine thus comprises a rotor which is capable of being driven and on the periphery of which is arranged an annular sterile room which surrounds the vertical axis of the machine concentrically and which is formed inside a casing and is demarcated from the non-sterile room by a plurality of walls.

In this case some walls are provided on the rotor, which rotate with the latter and other walls are provided on a machine frame, which do not rotate with the rotor. A hydraulic seal is arranged between these walls. The closure stations arranged in the periphery of the rotor have a closure tool which has a drive arranged outside the sterile room and a spindle which is arranged in part outside the sterile room and extends through the hydraulic seal or the siphon seal as far as the sterile room. This hydraulic seal has a highly complex design outside the first wall regions.

In addition, DE 10 2008 056 242 A1 describes a closure apparatus for containers, which has a closure head for applying the closures to the containers, which closure head is arranged inside a sterile room and performs a translational and a rotational movement. These reciprocating and rotational movements are transmitted to the closure head by a movement device which is arranged in part outside the sterile room and which produces the movement itself or is moved by a drive element arranged outside the sterile room. The sterile room is bounded by a first wall and has an annular channel into which the first wall projects. This annular channel is movable with respect to the first wall and is filled with a liquid and thus forms a so-called surge chamber together with the first wall.

This surge chamber seals the non-sterile area off from the sterile area. The movement device extends through this surge chamber from the non-sterile area into the sterile room. To this end a cylindrical body through which the movement device extends is arranged in the annular channel and is connected to it in a fixed manner. In addition, the movement device has a cylindrical body which is arranged on it and the peripheral wall of which projects into the liquid independently of the position of the movement element. In order to seal the clean room off from the non-clean room, this apparatus accordingly requires bodies which are designed in a complicated manner and which are arranged one in the other in such a way that sealing by means of a surge chamber can take place even in the case of a translational or rotational movement of the movement device.

Accordingly, it may be desirable to make available an apparatus for the closure of containers, which despite a simple structural design permits an adequate sealing of the clean room off from the non-clean room even during the movement of the movement device in the rotational and the translational directions and, as a result, is economical to produce and simple to assemble and maintain.

SUMMARY

According to various aspects of the disclosure, an apparatus for the closure of containers, for example, by screw-type closures, has at least one closure head—situated in a clean room sealed off by a medium—for applying the closures and a movement device arranged at least in part in the clean room for producing a rotational movement of the closure head about a longitudinal axis of the movement device and a translational movement of the closure head along the longitudinal axis of the movement device, in which case the movement device is contacted at least locally by the medium for sealing off the clean room from a non-clean room.

As compared with the prior art, a possible advantage of the present disclosure is that for example a complicated design of the movement device with cylindrical bodies additionally provided is not necessary in order to demarcate or seal off the clean room from the non-clean room or the ambient space.

The rotational and the translational movement can be produced for example by an electric motor which is arranged outside the clean room and which passes the movement on to the movement device which in turn transmits the movement to the closure head.

It is also possible for the movement device to be a servo motor or a magnetic or hysteresis clutch. In addition, lifting cams can also be used.

The apparatus for the closure of containers is in some aspects arranged on a circular plate-like support element which is arranged centrally with a rotor or the rotor axis thereof orientated in the vertical direction as well as in the vertical direction above the rotor. The clean room, which is in some aspects demarcated by a plurality of walls from the non-clean room, may advantageously extend in the peripheral direction around the rotor.

The support element forms the first upper wall of the clean room.

The movement direction thus extends through this support element or through the first upper wall from the non-clean room into the clean room. In order consequently to seal off the clean room from the non-clean room, a suitable seal, which is in some aspects a hydraulic seal, is necessary.

To this end, the upper wall in some aspects has an annular channel which extends in the peripheral direction on the upper side of the wall in the vertical direction. A region of a second upper wall, which is arranged in a stationary manner, i.e. immovably with respect to the first upper wall, in some aspects extends into this channel. A liquid medium, such as for example a disinfection agent, into which the region of the second upper wall engages, is present inside the channel.

In this way, during a rotational movement of the first upper wall about the axis of the rotor with respect to the second upper wall the clean room is sealed off from the non-clean room.

In addition, a cylindrical or sleeve-shaped guiding or holding element, which has only one outer face, may be advantageously arranged on the lower side of the first upper wall in the vertical direction.

The guiding element allows the medium to flow downwards in the vertical or translational direction into the guiding element.

In an exemplary embodiment the movement device extends through this guiding element from the non-clean room in the direction of the clean room.

It may be advantageous for the portion of the movement device arranged below the first upper wall in the translational direction to have the closure head arranged in a substantially rotationally rigid manner at a lower end in the translational direction, in order to include or perform the rotational and/or translational movement transmitted by the movement device.

This means that the rotational and/or reciprocating movement is transmitted for example from the drive unit to the movement device and is passed on from the latter to the closure head, so that the latter rotates about its axis and moves upwards or downwards in the vertical or translational direction with respect to the first and/or second upper wall.

In addition, a folding bellows extensible in the translational direction for sealing off the clean room with respect to a non-clean room during a translational movement of the movement device is provided in some aspects, it being desirable for this to be arranged at least locally on the movement device.

Accordingly, the folding bellows may advantageously enclose at least one portion of the movement device over its entire periphery and, in addition, in an exemplary manner it has an inner surface in contact with the medium and, in particular, also an outer surface in contact with the clean room.

In this way, for example, the medium can flow out of the hydraulic seal, which forms a so-called surge chamber between the first and the second upper wall, along the inside of the guiding element as well as along the outer surface of the movement device as far as the region of the folding bellows and can be present in the intermediate space, which the folding bellows forms with respect to the movement device, or in the folds of the folding bellows. The disinfection agent present inside the folding bellows is regularly changed by the pumping effect resulting from the translational movement.

It may be desirable for the medium to be present in a continuous manner along the outer surface of the movement device from the surge chamber as far as the upper end of the closure head situated in the vertical direction.

The upper end of the folding bellows in the translational direction is in some aspects arranged on a sleeve-like hub element capable of being turned in a rotary manner about the longitudinal axis of the movement device.

In this case the hub element can be connected for example to the movement device in a positively locking manner, as a result of which partial areas of the inner surface of the hub element do not rest directly against the outer surface of the movement device. The intermediate space resulting from this is used so that the medium of the hydraulic seal can flow or spread out along the movement device in the direction of the folding bellows.

Since the hub element is connected to the movement device in a rotationally rigid manner in some aspects with positive locking, in a corresponding manner it also carries out the movements transmitted by the movement device.

Accordingly, the hub element can rotate for example about the longitudinal axis of the movement device or can move up and down in the translational direction.

It may be desirable, however, for the hub element to be capable only of transmitting rotational movements and it is thus arranged on the movement device in such a way that only the rotational movement of the movement device is carried out by the hub element. Accordingly, the translational movements of the movement device are not absorbed by the hub element, so that the hub element acts like a sort of floating bearing.

Accordingly, the movement device in some aspect moves upwards and downwards in the translational direction with respect to the hub element and during this it extends and compresses respectively the folding bellows which is arranged around the movement device in the peripheral direction.

Since it may be advantageous for the upper end of the folding bellows to be connected to this hub element, the folding bellows also turns in this way about the longitudinal axis of the movement device during a rotational movement of the hub element about the longitudinal axis of the movement device.

In addition, the folding bellows is in some aspects connected by its lower end in the translational direction to the closure head or a lower region of the movement device. In this way, for example, the closure head, the folding bellows, the movement device and the hub element in some aspects move at the same angular speed about the longitudinal axis of the movement device during a rotational movement which is necessary for example for screwing on or unscrewing a lid or cap, for example, onto or off a container.

In an exemplary embodiment at least the inner surface of the hub element is consequently in contact with the medium at least in part, since the medium flows out of the annular channel through the guiding element and into the hub element.

The hub element, which may be advantageously connected to the movement device in a rotationally fixed manner, is in some aspects surrounded at least in part by a cylindrical guiding element, the two elements may be advantageously arranged concentrically with respect to each other.

This means that the hub element is arranged at least in part inside the guiding element, in which case a contact seal is arranged in the peripheral direction between the inner surface of the guiding element and the outer surface of the hub element.

In this way, the hub element and the guiding element in some aspects form a mounting for the rotational movement of the movement device.

It thus may be advantageous for the inner surface of the guiding element and the contact seal to be in contact with the medium at least locally in each case.

Accordingly, in an exemplary embodiment the medium, which is a component part of the hydraulic seal, extends in the translational direction along the movement device and surrounds the movement device over its entire periphery.

The medium thus flows through the guiding element, the hub element and the folding bellows.

The hydraulic seal itself is in some aspects a liquid seal for sealing off the stationary or non-moving wall with respect to at least one movable wall of a plant for the closure of containers, which forms a so-called surge chamber, as mentioned above.

Since the medium may advantageously form essentially a boundary region between the clean room and the non-clean room, only that region which is separated by the medium from the non-clean room is to be regarded as the clean room.

Because the medium extends along the outer surface of the movement device, the movement device itself is arranged in the non-clean room. Accordingly, for example the outer surface of the folding bellows or the outer surface of the guiding element is situated essentially in the clean room.

Consequently the clean room in some aspects has walls which are movable towards one another, since for example the walls of the rotor and of the support move with respect to the stationary wall.

In addition, the hub element also forms for example a wall which is in some aspects arranged so as to be movable with respect to the guiding element. Furthermore, the outer surface of each fold of the folding bellows in some aspects also forms a wall of the clean room, which can be moved towards each other on account of the extension or compression of the folding bellows.

In addition, a plant for the closure of containers with a plurality of apparatus of the type described above is claimed, which apparatus are arranged on a support movable in a rotational manner about a longitudinal axis of the rotor.

This plant consequently has for example a rotor with a longitudinal axis extending in the vertical or translational direction and a circular, plate-like support arranged concentrically with the longitudinal axis of the rotor.

On or through this support a plurality of apparatus according to the disclosure for the closure of containers are arranged substantially in the peripheral direction of the support (for example, advantageously at a uniform distance from one another), which extend substantially in the translational direction through the wall of the support.

Accordingly the plant according to the disclosure requires a seal for sealing off the clean room from the non-clean room.

In an exemplary embodiment the support is consequently sealed off from a stationary wall by an hydraulic seal.

As a result, on its upper surface in the translational direction the support in some aspects has a continuous annular channel with walls extending upwards in the translational direction, into which annular channel a portion of the stationary wall engages and into which the medium for sealing is introduced.

This stationary wall is the second upper wall already mentioned, and the support or the support plate forms the first upper wall. In order to produce a movement, in some aspects a rotational movement of the support about the longitudinal axis of the rotor without contamination of the clean room by the non-clean room, the hydraulic seal produces a surge chamber, which separates the non-clean room from the clean room, by means of, for example, a liquid medium.

This medium for sealing off the support from the stationary wall may be advantageously the same medium which also contacts the movement device.

In this way, the medium of the hydraulic seal extends not only inside the annular channel but also along the surface of the movement device as far as the closure head which, however, is in some aspects not acted upon by the medium.

Consequently the medium in some aspects also does not reach into the clean room.

It may be desirable for the medium on the lower end of the folding bellows in the vertical direction—the folding bellows being arranged on the closure head—to be bounded for example by a lower wall of the folding bellows or an upper wall of the closure head and for it thus not to be able to spread or accumulate in or around the closure head.

By way of example, an emptying apparatus may be advantageously arranged at the lower end of the folding bellows for a "production end" and/or "cleaning" and/or "drainage" operating state. As a result, contrary to the properties described above, which are necessary for example for a "production" operating state, the medium situated in the interior space of the folding bellows can be deliberately discharged. Since the disinfectant agents generally used lose their effectiveness by degradation over time, constantly fresh, reactive medium can also be replenished in this way.

Further advantages, aims and properties of the present disclosure are explained with reference to the following description of accompanying drawings, in which a plant known from the prior art for the closure of containers and an embodiment of an apparatus according to the disclosure for the closure of containers are illustrated by way of example.

Components which correspond at least substantially with respect to their function in the figures can be designated with the same references in this case, it being unnecessary for these components to be designated or explained in all the figures.

DETAILED DESCRIPTION

Figure 1:
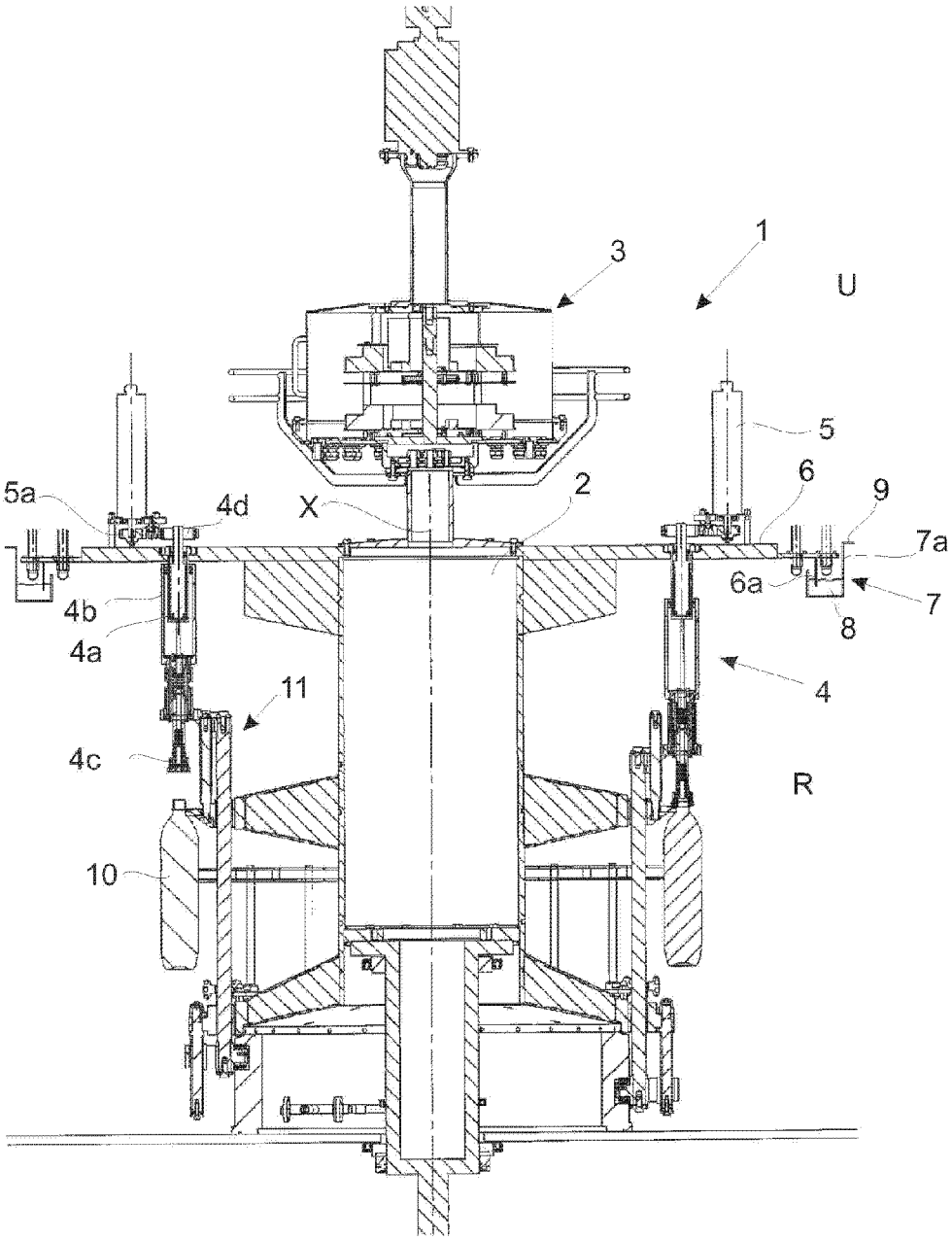
Fig.1 (PRIOR ART)
FIG. 1 shows a plant known from the prior art for the closure of containers.

FIG. 1 shows a plant 1 known from the prior art for the closure of containers 10, which has a rotor 2 with a longitudinal axis X extending in the translational direction, a rotor drive element 3 driving and controlling the rotor 2, two apparatus 4 for closing the containers 10 and with one apparatus drive unit 5 in each case, the apparatus drive units 5 being arranged on a support 6, and an hydraulic seal 7 with a medium 8.

It is not necessary for the plurality of further holding and/or guiding elements arranged in and on the plant 1 to be explained in greater detail in this case, since their arrangement is not relevant for the subject matter essential to the disclosure.

In this case the apparatus 4 for closure purposes has movement devices or movement transmission devices comprising two elements 4*a*, 4*b*, a rotational movement of the second movement device element 4*b* being caused by a rotational movement of the first movement device element 4*a*, as a result of which the closure head 4*c* is likewise caused to perform a rotational movement, for example, for closing and/or possibly also for opening containers with closure caps.

The translational movement of the closure head 4*c* with respect to the container 10 is made possible by a second movement device 11, in order for example to apply the closure head 4*c* to the container 10 which, for example, already has a closure cap (not shown here).

These rotational movements are produced by the drive unit 5, in which case a toothed wheel 4*d*, which is connected to the first movement device element 4*a* in a rotationally rigid manner, is driven by way of another toothed wheel 5*a* or a pinion 5*a* and transmits this movement to the first movement device element 4*a*.

The hydraulic seal 7 is formed from an annular channel element 7*a* which is arranged on a stationary or non-moving wall 9, whilst the support 6 constitutes a wall 6 movable with respect to the latter, in which case a portion 6*a* of the support 6 extending downwards in the translational direction dips (for example, in a circulating manner) into a medium 8 which is arranged inside the channel 7*a*.

In this way, a clean room R is sealed off from a non-clean room U, i.e. from the environment, by this hydraulic seal 7 which is also referred to as a surge chamber 7.

This means that the closure head 4*c*, the second movement device element 4*b* and the container 10 are present inside the clean room R, whereas areas of the first movement device element 4*a* are arranged outside the clean room R in the non-clean room U.

This transition region of the first movement device element 4*a* from the non-clean room U into the clean room R is sealed off for example by a contact seal or sealing rings (not shown here) or the like.

Figure 2:
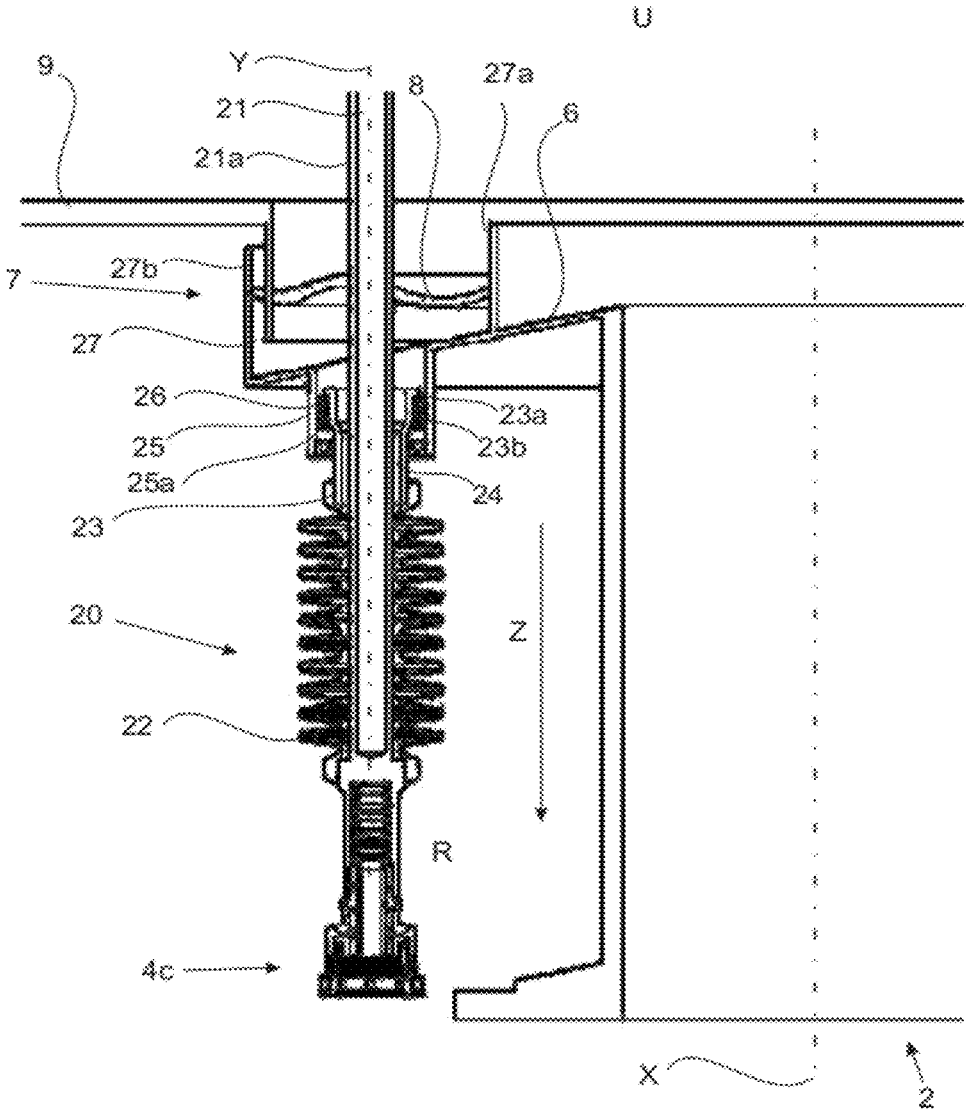
FIG. 2 is a sectional drawing of an exemplary embodiment of the apparatus for the closure of containers according to various aspects of the disclosure.

FIG. 2 is a sectional drawing of an embodiment of the apparatus 20 according to the disclosure for the closure of containers (not shown here), the apparatus 20 having a rod-shaped movement device 21 which extends through a support 6 in the translational direction Z from a non-clean room U in the direction of a clean room R.

In this case the apparatus 20 has a closure head 4*c*, on the upper end of which in the translational direction a folding bellows 22 is arranged. This folding bellows 22 surrounds the movement device 21 over its entire periphery along a defined area and it is connected by its upper end in the translational direction to a sleeve-shaped hub element 23.

On account of the connection of the hub element 23 to the movement device 21 in a rotationally fixed or a rotationally rigid manner the hub element 23 rotates at exactly the same angular speed as the movement device 21 when the latter is driven in rotation about a longitudinal axis Y of the movement device by a drive unit (not shown here).

Consequently the folding bellows 22, which is, for example, connected to the hub element 23 in a rotationally rigid manner, is also moved at the same angular speed about the longitudinal axis Y of the movement device as the hub element 23.

The hub element 23 is, for example, connected to the movement device 21 in a positively locking manner in order to form intermediate spaces 24 between the outer surface 21*a* of the movement device 21 and the inner surface 23*a* of the hub element 23. The hub element 23 is surrounded at least in part in the peripheral direction by a cylindrical or sleeve-shaped guiding element 25 so that the hub element 23 is arranged at least with a defined area inside the guiding element 25, the two elements 23 and 25 being situated concentrically with respect to each other.

A contact seal 26 is arranged between the hub element 23 and the guiding element 25, so that the intermediate space between the outer surface 23*b* of the hub element 23 and the inner surface 25*a* of the guiding element is completely filled by means of the contact seal 26.

The contact seal 26 is consequently arranged around the hub element 23 in the peripheral direction.

The guiding element 25 is a portion of the support 6 and it is arranged on the lower side thereof in the translational direction. On the side of the support 6 opposite this side the support 6 forms an annular channel 27 which comprises two walls 27*a* and 27*b* extending upwards in the translational direction and arranged at a distance from each other and closed in the peripheral direction of the support 6.

Accordingly the first wall 27*a* forms an inner circle and the second wall 27*b* forms an outer circle.

A medium 8, which is, for example, a liquid medium such as for example a disinfection agent, is present in the channel 27.

Consequently the medium 8 may in some aspects extend not only inside the channel 27 but also along the outer surface 21*a* of the movement device 21 in the direction of the closure head 4*c*.

In this way, the medium 8 passes the inner surface 25*a* of the guiding element 25, the inner surface 23*a* and in part the outer surface 23*b* of the hub element 23, and at least locally the contact seal 26 and it fills the folding bellows 22 or the individual folds of the folding bellows 22 respectively.

Because of a lower wall (not shown here) of the folding bellows 22 or an upper wall (not shown here) of the closure head 4*c* for example, the medium 8 cannot penetrate or flow out of the folding bellows into the clean room R.

By way of example, a suitable emptying apparatus (not shown), such as for example a ball valve, can be provided in a lower wall (not shown here) of the folding bellows 22 or an upper wall (not shown here) of the closure head 4*c*. In order to actuate this emptying apparatus, a suitable actuation device (not shown) is likewise provided.

Consequently the medium 8 in some aspects forms a boundary area between the clean room R and the non-clean room U, as a result of which for example the movement device is accordingly still situated completely inside the non-clean room U, whereas the outer walls of the folding bellows are already present inside the clean room R.

In this way the medium 8 of the hydraulic seal 7 is arranged not only inside the channel 27 but also on individual components of the apparatus 20 and it surrounds them.

It will be apparent to those skilled in the art that various modifications and variations can be made to the apparatus for the closure of container with clean room of the present disclosure without departing from the scope of the invention. Throughout the disclosure, use of the terms "a," "an," and "the" may include one or more of the elements to which they refer. Other embodiments of the invention will be apparent to those skilled in the art from consideration of the specification and practice of the invention disclosed herein. It is intended that the specification and examples be considered as exemplary only.

What is claimed is:

1. An apparatus for the closure of containers, comprising:

at least one closure head for applying a closure, the at least one closure head being situated in a clean room sealed off by a medium;

a movement device arranged at least in part in the clean room, the movement device being configured to produce a rotational movement of the closure head about a longitudinal axis of the movement device and a translational movement of the closure head along the longitudinal axis of the movement device, the movement device being contacted by the medium to seal off the clean room from a non-clean room via a hydraulic seal comprising a liquid seal sealing off a non-moving wall with respect to at least one movable wall of a plant for the closure of containers;

a folding bellows arranged locally on the movement device and extensible in a translational direction corresponding to the translational movement, wherein the folding bellows seals the clean room off from the non-clean room during the translational movement of the movement device, and wherein the folding bellows encloses at least a portion of a periphery of the movement device and has an inner surface in contact with the medium and an outer surface in contact with the clean room; and a hub element connected to the movement device in a rotationally fixed manner forming intermediate spaces between an outer surface of the movement device and an inner surface of the hub element, wherein the medium comprises a liquid and is a component part of the hydraulic seal, contacts at least the inner surface of the hub element extends in the translational direction along the movement device, and surrounds the movement device over at least a portion of the periphery of the movement device.

2. An apparatus according to claim 1, wherein the at least one closure head is arranged in a substantially rotationally rigid manner at a lower end of the movement device in a translational direction corresponding to the translational movement, in order to include or perform translational movement transmitted by the movement device.

3. An apparatus according to claim 1, wherein an upper end of the folding bellows in the translational direction is arranged on the hub element capable of being turned in a rotary manner about the longitudinal axis of the movement device.

4. An apparatus according to claim 3, wherein the hub element is surrounded at least in part by a cylindrical guiding element, so that the hub element and the cylindrical guiding element are arranged concentrically with respect to each other.

5. An apparatus according to claim 4, wherein a contact seal is arranged in a peripheral direction between an inner surface of the guiding element and an outer surface of the hub element.

6. An apparatus according to claim 4, wherein the inner surface of the guiding element is in contact with the medium.

7. An apparatus according to claim 5, wherein the contact seal is in contact with the medium.

8. An apparatus according to claim 1, wherein the clean room has walls which are movable towards one another.

9. An apparatus according to claim 1, wherein the medium substantially forms a boundary area between the clean room and the non-clean room.

10. A plant for the closure of containers comprising a plurality of apparatuses according to claim 1, which are arranged on a support movable in a rotational manner about a longitudinal axis of the rotor, wherein the longitudinal axis corresponds to a rotation axis of the rotor.

11. A plant according to claim 10, wherein the support is sealed off from a stationary wall by a hydraulic seal.

12. A plant according to claim 11, wherein the medium for sealing off the support from the stationary wall is the same medium which also contacts the movement device.

13. A plant according to claim 11, wherein the support has a continuous annular channel, into which a portion of the stationary wall engages and into which the medium for sealing is introduced.

14. The plant of claim 10, wherein the hydraulic seal is formed from an annular channel element which is arranged on a stationary wall, wherein the support comprises a wall movable with respect to the support, and wherein a portion of the support extends downwards in the translational direction and dips into a medium arranged inside the annular channel element.

15. The apparatus of claim 1, wherein the movement device is movable in its entirety along the longitudinal axis, the movement device being in direct contact with the medium.

16. The apparatus of claim 1, wherein the medium of the hydraulic seal extends not only inside an annular channel but also along a surface of the movement device as far as the at least one closure head which is not acted upon by the medium.

17. The apparatus of claim 1, wherein the hydraulic seal is formed from an annular channel element which is arranged on a stationary wall.

18. The apparatus of claim 1, wherein the hydraulic seal is a surge chamber.

* * * * *